US005572901A

United States Patent [19]

Wilhelm

[11] Patent Number: 5,572,901

[45] Date of Patent: Nov. 12, 1996

[54] LOCATOR FOR METAL FLANGING APPARATUS

[75] Inventor: Matthew L. Wilhelm, Rochester Hills, Mich.

[73] Assignee: Active Design, Inc., Warren, Mich.

[21] Appl. No.: 426,225

[22] Filed: Apr. 21, 1995

[51] Int. Cl.[6] ..... B21D 5/04

[52] U.S. Cl. ..... 72/461; 72/313; 72/420

[58] Field of Search ..... 72/312, 313, 314, 72/315, 316, 461, 460, 420, 421

[56] References Cited

U.S. PATENT DOCUMENTS

| | | | |
|---|---|---|---|
| 3,402,452 | 9/1968 | Mraz | 72/461 |
| 3,421,359 | 1/1969 | Gibbs . | |
| 4,019,236 | 4/1977 | Osman | 72/460 |
| 4,274,352 | 6/1981 | Hamel . | |
| 4,485,660 | 12/1984 | Takeuchi et al. | 72/313 |
| 4,487,051 | 12/1984 | Iwamoto | 72/461 |
| 4,561,281 | 12/1985 | Tran et al. . | |
| 4,583,391 | 4/1986 | Stafford . | |
| 4,598,570 | 7/1986 | Baldyga . | |
| 4,658,624 | 4/1987 | Ridgway et al. . | |

FOREIGN PATENT DOCUMENTS

| | | | |
|---|---|---|---|
| 2483273 | 12/1981 | France . | |
| 0199236 | 9/1987 | Japan | 72/461 |
| 0618161 | 8/1978 | U.S.S.R. | 72/461 |
| 1144749 | 3/1985 | U.S.S.R. . | |
| 1269897 | 11/1986 | U.S.S.R. . | |

*Primary Examiner*—David Jones
*Attorney, Agent, or Firm*—Brooks & Kushman P.C.

[57] ABSTRACT

An adjustable locator device locates a sheet metal workpiece laterally on a metal forming die. The locator device includes a pivotal locator portion which engages a driver member of the flanging assembly in order to pivot the locator to engage and position the workpiece. The locator portion is movably mounted to a base in order to facilitate longitudinal movement of the locator portion to clearly locator portion and expose the workpiece to the flanging steel for flanging of the workpiece. The locator device includes a pair of springs for biasing the locator portion toward a tilted position for engagement with the driver member, and for biasing the locator portion in the direction of the flanging steel.

17 Claims, 3 Drawing Sheets

LOCATOR FOR METAL FLANGING APPARATUS

TECHNICAL FIELD

The present invention relates to a metal stamping apparatus, and more particularly to an adjustable locator device for locating a sheet metal workpiece laterally on a metal forming die.

BACKGROUND OF THE INVENTION

In many applications of sheet metal parts, the relative location of the preformed and shaped features are critical. A bend that is off even a few thousandths of an inch will place an edge or screw hole far enough out of position to render the part unacceptable. Accordingly, metal flanging operations are required to be accurate within a few thousandths of an inch in certain applications, such as flanging a piece of sheet metal for a vehicle door exterior.

Often, the sheet metal is merely placed into the flanging die without the aid of lateral locators to position the sheet metal properly for flanging. This leads to wide variations in flanging accuracy. However, in certain locator systems for metal stamping presses, a rigid gauge is secured to the stationary die member for locating the sheet metal on the stationary die member. In order to avoid interference between the flanging steel of the movable die member and the locator gauge, a portion of the flanging steel is removed. Removal of flanging steel leads to reduced quality of the flange because a gap is created between the flanging steel and the stationary die member in the area where flanging steel has been reduced. This adversely effects the accuracy of the flange, as well as the consistency of the bend in the sheet metal.

Accordingly, it is desirable to provide a locator device which accurately locates the sheet metal on the stamping press, while not interfering with the flanging steel.

SUMMARY OF THE INVENTION

The present invention addresses problems experienced in the prior art sheet metal assemblies by providing a sheet metal locator which is capable of longitudinal movement when engaged with the flanging steel in order to clear the locator from the flanging area and expose the sheet metal to the flanging steel for flanging.

The present invention contemplates an adjustable locator device for locating a sheet metal workpiece laterally on a metal forming die. The die includes a stationary member, a flanging member movable in a longitudinal direction for forming the sheet metal, and a driver movable with the flanging member. The locator device comprises a base adapted for attachment to the stationary member. A translational member is movably mounted to the base for movement along a first axis. A locator portion is pivotally mounted to the translational member about an axis transverse of the first axis.

The present invention further contemplates an adjustable locator device for locating a workpiece on a forming die. The die includes a stationary member adapted to locate the workpiece in a longitudinal direction, a longitudinally reciprocable driver member movable with respect to the stationary member, and a longitudinally reciprocable flanging member movable with the driver member for flanging the workpiece. The locator device comprises a locator member secured to the stationary member. The locator member includes a longitudinally reciprocable translational member and a locator portion pivotable with respect to the translational member. The locator portion is engageable with the driver member to facilitate pivotal movement of the locator portion to engage and position the workpiece in a lateral direction. The locator portion is further engageable with the flanging member to facilitate movement of the locator portion longitudinally to expose the workpiece to the flanging member for flanging the workpiece after the locator portion has positioned the workpiece laterally.

The present invention further contemplates a die apparatus for flanging a workpiece. The die apparatus includes a stationary member, a driver member, and a pressure pad member. The die apparatus further includes a locator device as described above.

An object of the present invention is to provide an adjustable locator device which accurately locates sheet metal on a metal flanging die, and does not interfere with the flanging steel as the flanging steel engages the workpiece.

A further object of the present invention is to provide an adjustable locator device for locating a sheet metal workpiece laterally on a metal forming die, the locator device being engageable with the flanging steel to facilitate longitudinal movement of the locator to clear the locator device and expose the workpiece to the flanging steel for flanging.

The above objects and other objects, features and advantages of the present invention are readily apparent form the following detailed description of the best mode for Carrying out the invention when taken in connection with the accompanying drawings.

DETAILED DESCRIPTION OF THE PREFERRED EMBODIMENT

Figure 1:
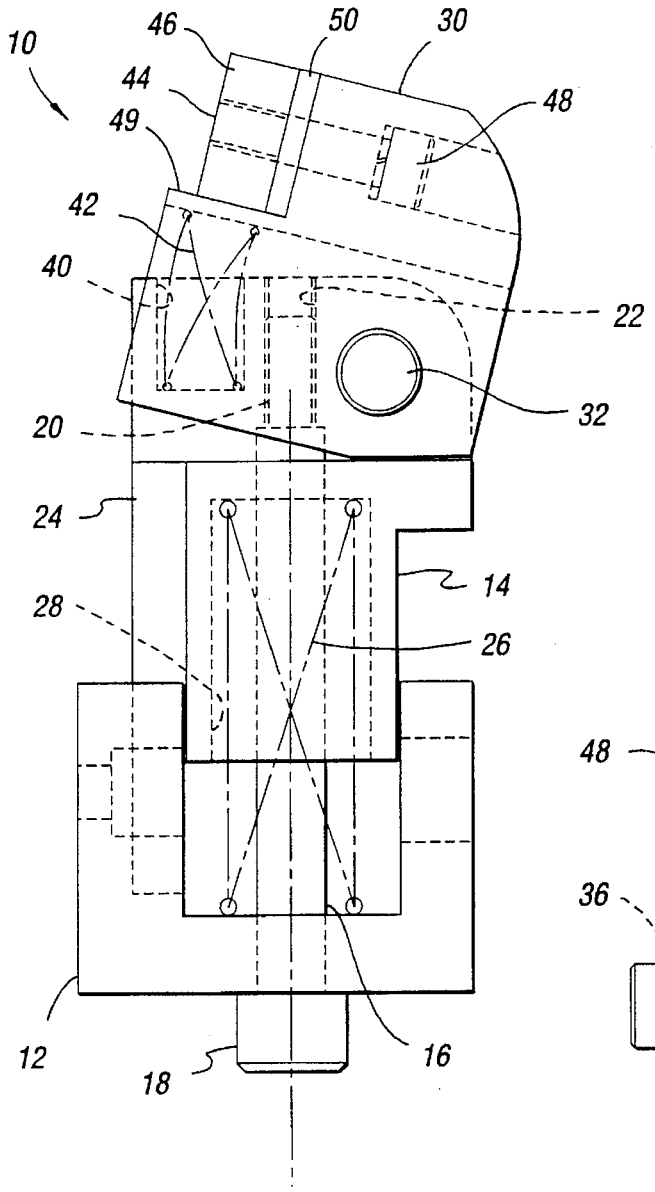
FIG. 1 is a side view of an adjustable locator device in accordance with the present invention.

Referring to FIG. 1, a locator device 10 is shown in accordance with the present invention. The locator device 10 includes a base 12 which is adapted to be mounted to a stationary die member of a sheet metal flanging press. A translational member 14 is movably mounted with respect to the base 12 along the support stud 16. The support stud 16 includes a head 18 at a first end, and a threaded second end 20. The translational member 14 is internally threaded in the aperture 22 to receive the threaded second end 20 of the stud 16. The translational member 14 further includes a rib 24, which is engageable within a slot 27 (FIG. 2) in the base 12 for sliding movement therein. A spring 26 is mounted concentrically on the stud 16 between the base 12 and the translational member 14. The spring 26 extends into an aperture 28 formed in the translational member 14. The spring 26 biases the translational member 14 toward an extended position away from the base 12.

Figure 2:
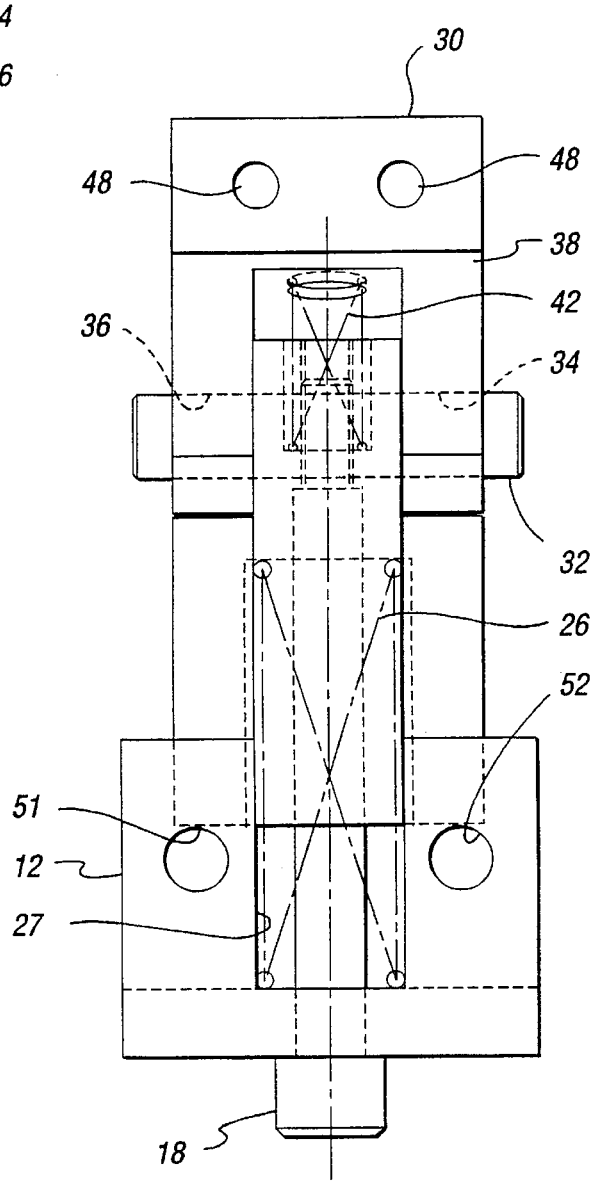
FIG. 2 is a frontal view of a locator device in accordance with the present invention.

The locator device 10 further includes a locator portion 30 pivotally mounted to the translational member 14 at the pivot pin 32. The pivot pin 32 extends through a pair of holes 34,36 formed through the yolk 38 of the locator portion 30 (See FIG. 2). The translational member 14 includes a cylindrical opening 40 formed therein adjacent the locator portion. A second spring 42 is received within the cylindrical opening 40, and engages the locator portion 30 to bias the locator portion 30 toward a tilted position for engagement with a driver member of the die flanging assembly. The locator portion 30 further includes a locator stop surface 44 on a locator stop plate 46 which is adapted for engagement with the workpiece. The locator plate 46 is secured by means of the adjustment screws 48. The extent to which stop plate 46, and the stop surface 44 extends outwardly along guide surface 49 determines the length of the metal flange and is adjusted by the addition of shims 50 of various widths. The mounting holes 51,52, shown in FIG. 2, are provided for mounting the base 12 to a stationary die member.

Figure 3:
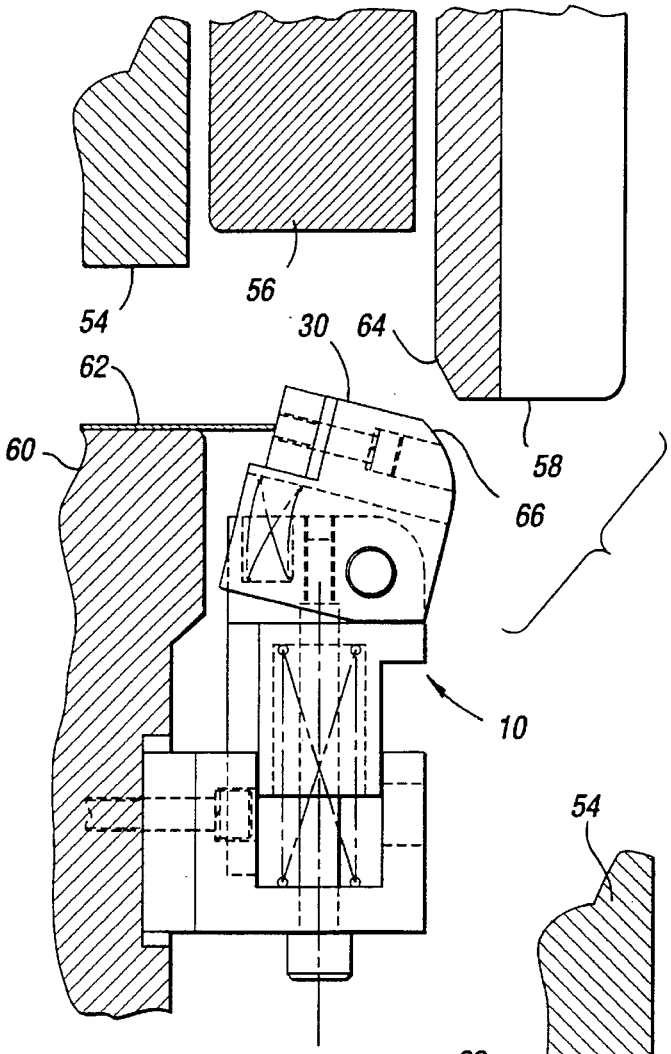
FIG. 3 is a side view of a locator device assembled with a metal flanging die in accordance with the present invention, prior to positioning of the workpiece on the stationary die.
Figure 4:
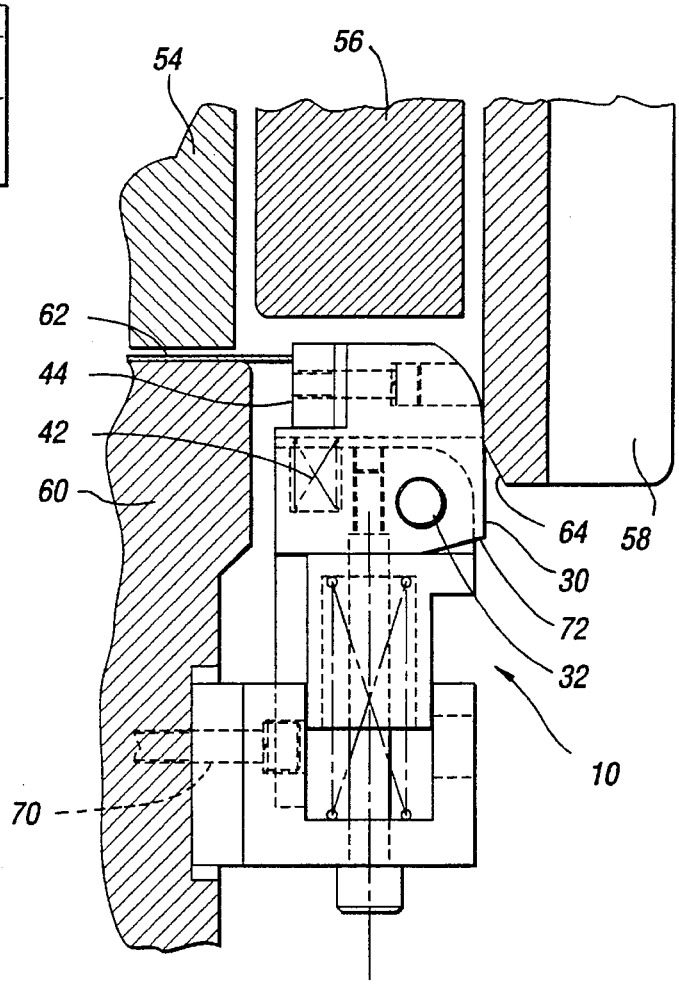
FIG. 4 is a side view of a locator device assembled with a metal flanging die, the locator device being engaged with the driver for positioning the workpiece laterally.

FIG. 3 shows the upper die assembly, comprising flanging die pressure pad 54, flanging steel 56 and driver member 58. In FIG. 3, the upper die assembly. is shown moving towards the stationary die member 60, workpiece 62, and locator device 10. The locator device 10 is secured to the die member 60 by the bolt 70. The driver member 58 includes a cam surface 64 formed thereon for engagement with the cam surface 66 of the locator portion 30. Workpiece 62 is fed laterally across die member 60 until engaging or nearly engaging stop surface 44 of the locator. As shown in FIG. 4, as the cam surface 64 of the driver member 58 moves along the cam surface 66 of the locator portion 30, the locator portion 30 pivots about the pivot pin 32 against the bias of the second spring 42. As the locator portion 30 pivots, the locator stop surface 44 first engages the workpiece 62, if it is not already in engagement with the initial placement of the workpiece within the die, and then locates the workpiece 62 by shifting it into the proper position laterally on the stationary die member 60. This configuration allows the locator portion 30 to actually move the workpiece 62 laterally, rather than merely preventing movement of the workpiece.

Figure 5:
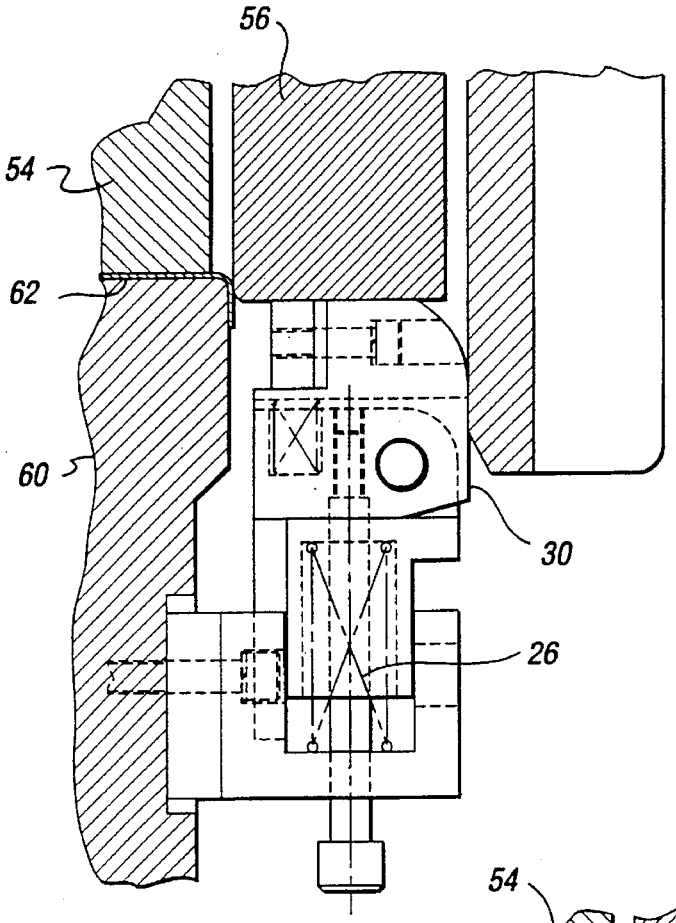
FIG. 5 shows a side view of a locator device assembled with a metal flanging die in accordance with the present invention, the locator device being engaged by the flanging steel.

Once the locator portion 30 has positioned the workpiece 62 laterally on the stationary die member 60, pressure pad 54 engages the workpiece 62 to secure the workpiece 62 in the located position for flanging, as shown in FIG. 5. When the pressure pad 54 has secured the workpiece 62, the upper die assembly continues its descent thereby allowing the driver member to engage the locator portion 30, rotating it about pivot point 32 as above described to thereby locate the outboard edge of workpiece 62 at a predetermined distance from stationary die 60. Thereafter, on continuous descent, the upper die assembly descends and the flanging steel 56 engages the locator portion 30 and moves the locator portion 30 longitudinally against the bias of spring 26. In this manner, the locator portion 30 is moved longitudinally to expose the workpiece 62 to the flanging steel 56 for flanging.

Figure 6:
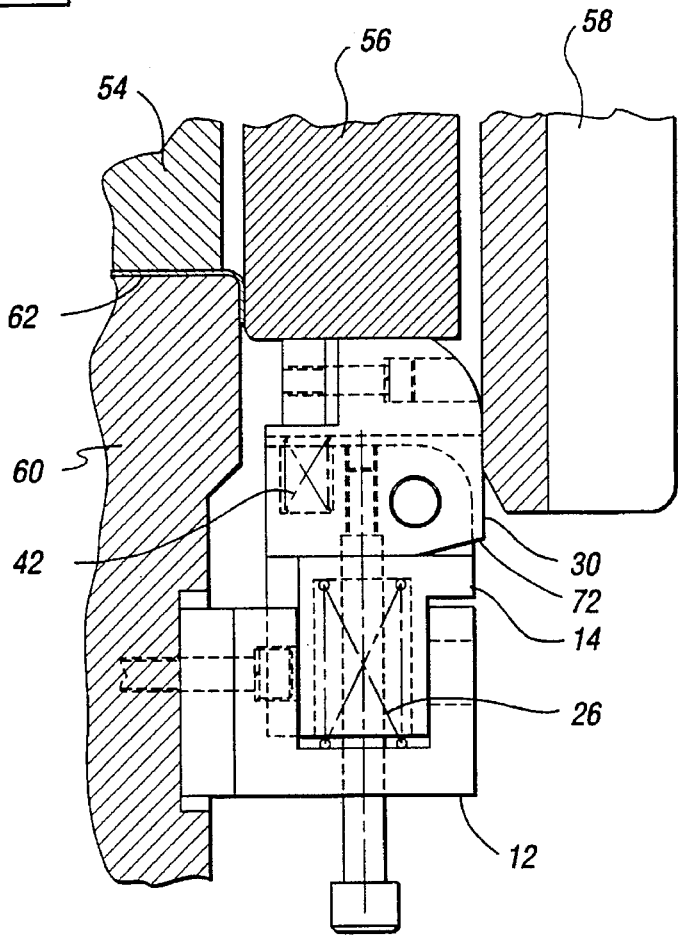
FIG. 6 shows a side view of a locator device assembled with a metal flanging die in accordance with the present invention, the locator device being fully retracted and the workpiece being flanged.

Finally, as shown in FIG. 6, the translational member 14 and locator portion 30 are completely collapsed longitudinally against the bias of the spring 26, and the flanging steel 56 flanges the workpiece 62 to produce a 90° bend and a flange of predetermined length from the fold to the edge of the workpiece. When the upper die assembly, namely the pressure pad 54, flanging steel 56, and the driver member 58, is retracted, the spring 26 biases the translational member towardan extended position away from the base 12, and the second spring 42 biases the locator portion 30 toward a fixed tilted position away from the translational member 14, as determined by the flat 72, in preparation for receiving the next workpiece 62 to be flanged and return engagement with the driver member 58.

While the best mode for carrying out the invention has been described in detail, those familiar with the art to which this invention relates will recognize various alternative designs and embodiments for practicing the invention. Thus, the above described preferred embodiment is intended to be illustrative of the invention which may be modified within the scope of the following appended claims.

What is claimed is:

1. An adjustable locator device for locating a sheet metal workpiece laterally on a metal forming die, the die including a stationary die member, a flanging member movable in a longitudinal direction for forming the sheet metal, and a driver movable with the flanging member, the locator device comprising:

a base adapted for attachment to the stationary die member;

a translational member movably mounted to said base for movement along a first axis;

a locator portion pivotally mounted to said translational member about an axis transverse of the first axis, and said locator portion including a workpiece stop surface.

2. The locator device of claim 1, further comprising a first spring positioned between said base and said translational member to bias said translational member to an extended unloaded position.

3. The locator device of claim 2, further comprising a guide pin for guiding movement of the translational member with respect to the base and along said first axis, said first spring positioned coaxially with said guide pin.

4. The locator device of claim 1, wherein said locator portion further comprises an adjustable locator stop surface for arresting movement of the workpiece and locating the workpiece relative to the stationary die member.

5. The locator device of claim 1, further including longitudinally oriented slot formed by said base for receiving and guiding said translational member along said first axis.

6. The locator device of claim 1, wherein said locator portion further comprises a cam surface for engagement with the driver as a means of causing said locator portion to pivot about said translational member and thereby locate a workpiece within the die prior to metal forming.

7. The locator device of claim 6, wherein said locator portion further comprises a yoke and pivot pin for pivotally mounting the locator portion to the translational member.

8. The locator device of claim 7, further comprising a second spring positioned between said locator portion and said translational member to bias said locator portion toward an extended position about said pivot pin.

9. In combination, an adjustable locator device for locating a workpiece on a forming die, the die including a stationary member adapted to locate the workpiece in a longitudinal direction, a longitudinally reciprocable driver member movable with respect to the stationary member, and a longitudinally reciprocable flanging member movable with the driver member for flanging the workpiece, the locator device comprising:

a locator member secured to the stationary member and having a longitudinally reciprocable translational member and a locator portion pivotal with respect to said translational member, said locator portion being engageable with the driver member to facilitate pivotal movement of the locator portion to engage and position the workpiece in a lateral direction; and said locator portion being engageable with the flanging member to facilitate movement of the locator portion longitudinally to expose the workpiece to the flanging member for flanging the workpiece after the locator portion has positioned the workpiece laterally.

10. The locator device of claim 9, wherein said locator member further comprises a base secured to the stationary member and a first spring positioned between said base and said translational member for biasing said translational member toward the flanging member.

11. The locator device of claim 10, further comprising a second spring positioned between said locator portion and said translational member to bias said locator portion toward a position of engagement with the driver.

12. The locator device of claim 10, further comprising a guide pin for guiding movement of the translational member with respect to the base, said first spring positioned coaxially with said guide pin.

13. The locator device of claim 9, wherein said locator portion further comprises an adjustable locator surface for engagement with the workpiece.

14. The locator device of claim 10, further comprising a slot formed by said base for receiving and guiding said translational member.

15. The locator device of claim 9, wherein said locator portion further comprises a yoke and pivot pin for pivotal mounting to the translational member.

16. The locator device of claim 9, wherein said locator portion comprises a cam portion for engagement with the driver.

17. A die apparatus for flanging a workpiece comprising:

a stationary member adapted to position the workpiece in a longitudinal direction;

a locator member adjacent said stationary member and having a longitudinally reciprocable translational portion and a locator portion pivotable with respect to said translational portion;

a longitudinally reciprocable driver member adjacent said locator member and having a cam portion engageable with said locator portion during reciprocation of said driver member in one direction to cause said locator portion to pivot whereby to position the workpiece in a lateral direction;

a longitudinally reciprocable pressure pad member engageable with the workpiece after said stationary member and said locator portion position the workpiece in said respective longitudinal and lateral directions; and a longitudinally reciprocable flanging member between said pressure pad member and said driver member, said flanging member being sequentially engageable with said locator portion and the workpiece sequentially to move said locator member in said longitudinal direction to expose the workpiece to said flanging member for flanging the workpiece after the locator portion has positioned the workpiece laterally.

* * * * *